United States Patent [19]

Agers et al.

[11] Patent Number: 4,492,009

[45] Date of Patent: Jan. 8, 1985

[54] YARN TEXTURING JET

[75] Inventors: Brian M. Agers; Arnold S. Goldstein, both of Wilmington, Del.

[73] Assignee: E. I. Du Pont de Nemours and Company, Wilmington, Del.

[21] Appl. No.: 536,314

[22] Filed: Sep. 29, 1983

[51] Int. Cl.[3] ..... D02G 1/16

[52] U.S. Cl. ..... 28/254; 28/272; 28/273

[58] Field of Search ..... 28/254, 272, 273

[56] References Cited

U.S. PATENT DOCUMENTS

| | | | |
|---|---|---|---|
| 3,449,805 | 6/1969 | Lubach | 28/273 |
| 3,577,614 | 11/1969 | Price | 28/272 |
| 4,259,768 | 4/1981 | Chendening, Jr. et al. | 28/254 |
| 4,282,637 | 8/1981 | Mosseri et al. | 28/254 |

*Primary Examiner*—Robert R. Mackey

[57] ABSTRACT

A self-stringing jet device which is compact and easy to string up includes a body, a yarn inlet section, a movable venturi and a cylindrical baffle located at the outlet end of the jet. The venturi may be moved from a string up position to an operating position between positive set points engaging the movable venturi located within the jet.

4 Claims, 3 Drawing Figures

YARN TEXTURING JET

BACKGROUND OF THE INVENTION

The invention relates to air texturing of yarn and more particularly, to improvements in a fluid jet apparatus used to texture the yarn.

U.S. Pat. No. 4,259,768, of common assignee, discloses a self-stringing jet device which is compact and easy to string up. The jet includes a body, a yarn inlet section, a movable venturi and a rotatable cylindrical baffle located at the outlet end of the jet. The venturi may be set to a string up position or to an operating position by one or more adjustable camming surfaces on the rotatable cylindrical baffle. In these embodiments, the movable venturi is mounted to adjust the relative axial positions of the venturi and the yarn guiding element which is fixed in the jet body. The adjustments are located on the external parts of the jet and readily available to be changed by the operators to the detriment of the quality of the yarn being produced. More particularly, each operator's perception of what constitutes good quality yarn can vary from operator to operator. For example, each operator may set the same jet differently for what may be considered in his own opinion to be good quality yarn and such differences in settings through human error lead to undesirable nonuniformity from machine to machine or jet to jet.

SUMMARY OF THE INVENTION

A jet device has now been found which provides positive set points for string up and operating positions which cannot be adjusted, thus eliminating the possibility of human error. This jet device includes a body having yarn inlet and outlet ends connected by a central bore, means for introducing pressurized gas through a gas inlet into said bore, a venturi located in said bore at the outlet end of the jet, a yarn guiding element extending into the bore from the yarn inlet end of the jet, the yarn guiding element has a passage through it for guiding yarn from the yarn inlet to the venturi, and a cylindrical baffle located at the outlet end of the jet. The venturi is axially slidable in the body from a preset operating position to a string up position back to a preset operating position and is attached to a collar having a circumferential groove therein located inside the body at the outlet end of the body. Means which may be in the form of a rotatable flat sided rod positioned in mounting holes in the body and a ball stop engaging said groove are used to positively position the venturi in the optimum string up or operating positions depending on the rotational position of the flat sided rod.

DETAILED DESCRIPTION OF THE PREFERRED EMBODIMENT

Figure 1:
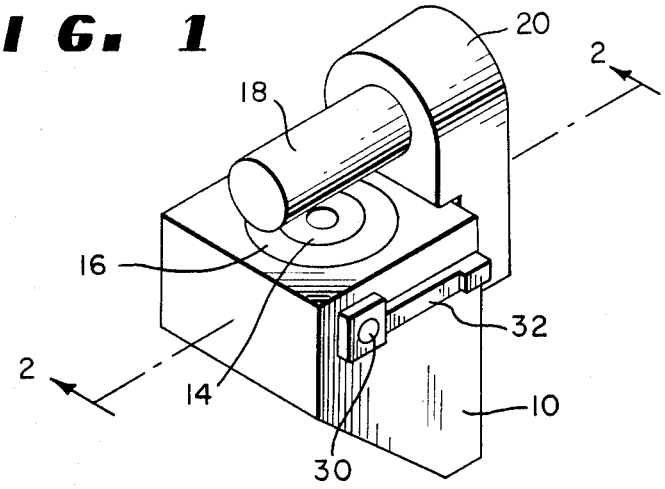
FIG. 1 is a perspective view of a preferred embodiment of the invention.

Referring to the drawing, the major elements of the jet device are body 10, yarn guiding element 12, movable venturi 14 with its attached collar 16 and baffle 18 with its supporting bracket 20 attached to body 10. Yarn guiding element 12 is press fitted into body 10 at the inlet end of the jet and consists of a cone shaped entrance 13 in communication with the yarn exit orifice 15 of the yarn guiding element. The outer portion of the yarn guiding element comprises a cylindrical portion 17 with a conical tip 19. Fluid orifice 22 has its axis parallel to the axis of yarn passage 17 and is supplied with fluid such as compressed air through fluid connection 23. Venturi 14 is free to move axially within the body 10 and a seal is formed between the venturi and body by O-ring seal 24 seated in an annulus 25 in the body. The venturi 14 is press fitted into collar 16 and collar 16 is free to move within the recess 26 at the outlet end of the jet body. A circumferential groove 28 is formed in collar 26. a rod 30 extends through body 10 and engages groove 28. The rod is rotatable in both the body and the groove. A handle 32 is attached to the end of the rod so that the rod may be easily rotated. The rod is not completely circular but has a flat sided cut 31 in it which is coincident with the groove 28. A ball stop 34 positioned in hole 36 in the body 10 is restricted in its movement within the hole by the location of set screw 38 threaded into bracket 20 on one side and the edges of groove 28 on the other side.

Figure 2:
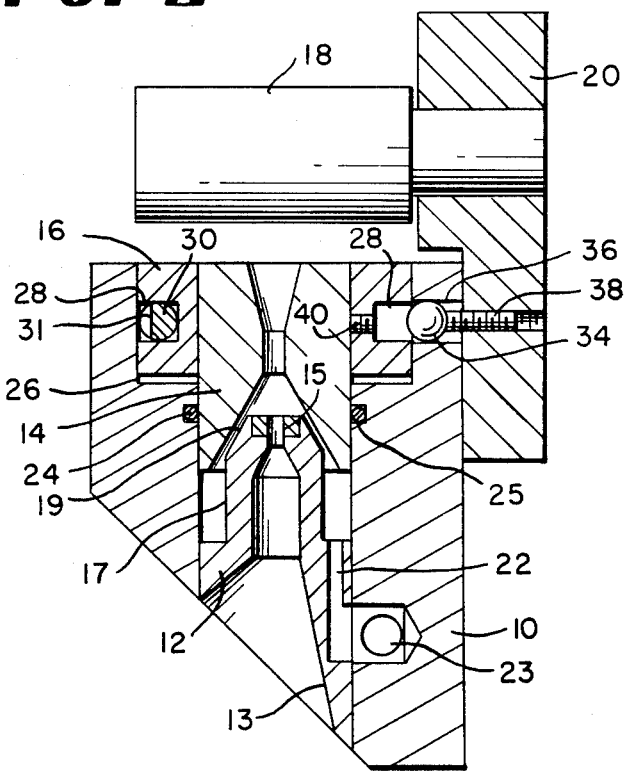
FIG. 2 is an enlarged section view of FIG. 1 taken along line 2—2 showing the jet in string up position.
Figure 3:
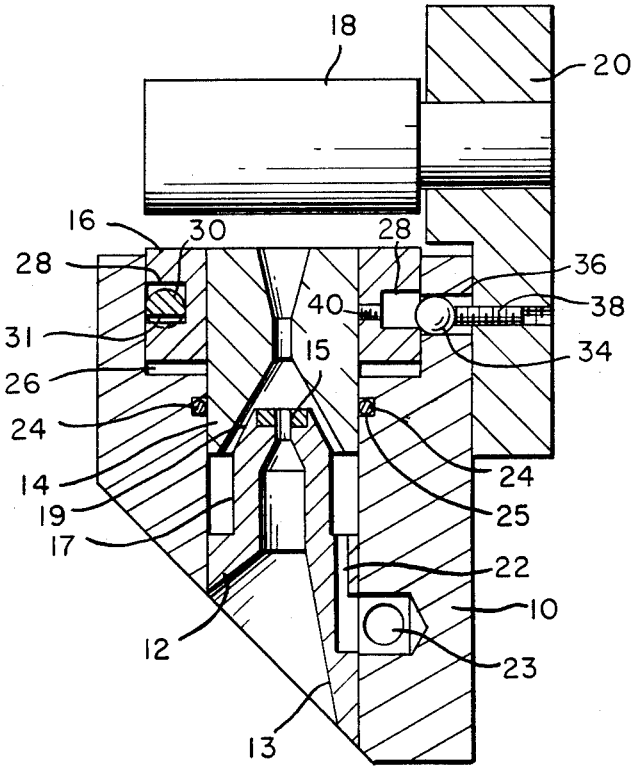
FIG. 3 is an enlarged section view of FIG. 1 taken along line 2—2 showing the jet in operating position.

The following procedure is used to set the optimum string up and operating procedures for the jet. Air pressure (approximately 140 psig) is applied to the jet through connection 23. With the collar 16 held in a fixed location within recess 28 by rod 30 (FIG. 2) the venturi is forced (using a machine press not shown) within the fixed collar towards the conical tip 19 of yarn guiding element 12 until the maximum amount of air is aspirating through cone shaped entrance 13. The collar is then fixed to the venturi via the set screw 40. Next the rod is rotated so that the flat 31 is in position shown in FIG. 3. This allows the collar 16 to move toward the outlet end of the jet under the force of the air pressure carrying with it venturi 14. The movement toward the outlet of collar 16 is defined by the ball stop 36 and its adjustment screw 38. When the adjustment screw is fully turned in, the ball stop holds the collar in the aspirating position. Since the diameter of the ball stop 36 is larger that the width of the groove backing off of set screw 38 allows the ball to move away from the groove to a location as shown in FIG. 3 which allows the air pressure to force the collar and venturi outward away from the yarn guiding element 12 a distance determined by the setting of screw 38 and the screw 38 is adjusted until the best operating point is reached for the jet. This is determined by the most stable delivery of yarn at the exit end of the jet or by maximizing the wind up tension of the yarn after it leaves the jet. The screw 38 is then cemented or fixed in place.

The operation of this device is as follows: when a yarn or yarns are to be strung up, rod 30 is turned by handle 32 to a position shown in FIG. 2 so that movable venturi is moved toward conical tip 19 thus restricting the flow of air until ambient air is aspirated through cone shaped yarn inlet section 13 into and through movable venturi 16. The operator then inserts yarn into the cone-shaped inlet 13 where the aspirated air assists in carrying the yarn through the venturi to the outlet end. The operator then rotates rod 30 to the position shown in FIG. 3 so that the movable venturi 16 is allowed to move away from conical tip 19 under the force of the air pressure within the jet until it reaches the optimum operating setting established by the location of ball stop 36.

We claim:

1. In a yarn texturing jet including a body having yarn inlet and outlet ends connected by a central bore, means for introducing pressurized gas through a gas inlet into said bore, a venturi located in said bore at said outlet end, said venturi being axially slidable in said body from a preset operating position to a string up position back to a preset operating position, a yarn guiding element extending into said bore from the yarn inlet end of the body, said yarn guiding element having a pasage therethrough for guiding yarn from the yarn inlet to the venturi and a cylindrical baffle attached to a bracket located adjacent the outlet end of the jet, the improvement comprising: a collar attached to said venturi, said collar having a circumferential groove and being slidably located inside the body at the outlet end thereof; and means engaging said groove to position said venturi in the string up position or the operating position.

2. The jet as defined in claim 1, said means for maintaining said venturi in said string up position or said operating position being a flat sided rod rotatably mounted in the body, the flat sided portion of said rod engaging said groove in the operating position and a ball stop partially extending into said groove, said ball stop having a diameter larger than the width of the groove.

3. The jet as defined in claim 1, including an O-ring seal between said venturi and said body.

4. The jet as defined in claim 2, said ball stop being backed by a set screw threaded into said bracket, said set screw being fixed in said bracket.

* * * * *